US009291138B2

(12) United States Patent
Morris et al.

(10) Patent No.: US 9,291,138 B2
(45) Date of Patent: Mar. 22, 2016

(54) FUEL INJECTOR WITH INJECTION CONTROL VALVE ASSEMBLY

(71) Applicant: CUMMINS INC., Columbus, IN (US)

(72) Inventors: Corydon E. Morris, Columbus, IN (US); Paul D. Free, Hope, IN (US)

(73) Assignee: CUMMINS INC., Columbus, IN (US)

( * ) Notice: Subject to any disclaimer, the term of this patent is extended or adjusted under 35 U.S.C. 154(b) by 596 days.

(21) Appl. No.: 13/666,791

(22) Filed: Nov. 1, 2012

(65) Prior Publication Data

US 2013/0118451 A1 May 16, 2013

Related U.S. Application Data

(60) Provisional application No. 61/554,117, filed on Nov. 1, 2011.

(51) Int. Cl.

| | |
|---|---|
| ***F02M 57/00*** | (2006.01) |
| ***F02M 61/16*** | (2006.01) |
| ***F02M 63/00*** | (2006.01) |
| ***F02M 63/02*** | (2006.01) |
| ***F02M 47/02*** | (2006.01) |
| ***F02M 59/36*** | (2006.01) |
| ***F02M 55/00*** | (2006.01) |
| ***F02M 51/06*** | (2006.01) |

(52) U.S. Cl.

CPC ..... *F02M 61/161* (2013.01); *F02M 47/027* (2013.01); *F02M 51/061* (2013.01); *F02M 55/002* (2013.01); *F02M 59/366* (2013.01); *F02M 63/0056* (2013.01); *F02M 63/0215* (2013.01); *F02M 63/0225* (2013.01)

(58) Field of Classification Search

CPC ..... F02M 47/027; F02M 63/0225; F02M 2200/21; F02M 2200/28; F02M 57/025; F02M 57/02; F02M 57/024; F02M 59/32; F02M 61/205; F02M 59/366; F02B 3/06; Y02T 10/144

USPC ..... 123/445

See application file for complete search history.

(56) References Cited

U.S. PATENT DOCUMENTS

| | | | |
|---|---|---|---|
| 3,288,190 | A | 11/1966 | Holmes |
| 4,071,067 | A | 1/1978 | Goldby |
| 4,076,064 | A | 2/1978 | Holmes |

(Continued)

FOREIGN PATENT DOCUMENTS

| | | |
|---|---|---|
| EP | 1 705 365 B1 | 9/2006 |
| GB | 2 104 158 A | 3/1983 |

(Continued)

OTHER PUBLICATIONS

International Search Report and Written Opinion of the International Searching Authority dated May 15, 2013 from corresponding International Application No. PCT/US2012/063078.

*Primary Examiner* — Hai Huynh
*Assistant Examiner* — Gonzalo Laguarda
(74) *Attorney, Agent, or Firm* — Faegre Baker Daniels LLP

(57) ABSTRACT

A fuel injector control valve is provided that includes a drain circuit for directing the flow of fuel away from temperature sensitive components of a fuel injector in which the fuel injector control valve is positioned. The drain circuit includes at least one portion that directs drain fuel axially inward or toward a fuel injector orifice, and away from an actuator of the fuel injector.

17 Claims, 4 Drawing Sheets

(56) References Cited

U.S. PATENT DOCUMENTS

| | | | | | |
|---|---|---|---|---|---|
| 4,258,607 | A | | 3/1981 | McKewan | |
| RE31,284 | E | | 6/1983 | Holmes | |
| 4,402,456 | A | * | 9/1983 | Schneider | 239/90 |
| 4,467,963 | A | * | 8/1984 | Sisson et al. | 239/90 |
| 4,485,969 | A | | 12/1984 | Deckard et al. | |
| 4,618,095 | A | * | 10/1986 | Spoolstra | 239/90 |
| 4,661,031 | A | | 4/1987 | Heine | |
| 4,911,127 | A | | 3/1990 | Perr | |
| 5,169,270 | A | | 12/1992 | Erickson | |
| 5,209,403 | A | | 5/1993 | Tarr et al. | |
| 5,301,875 | A | | 4/1994 | Gant et al. | |
| 5,385,301 | A | * | 1/1995 | Ueda | 239/88 |
| 5,501,197 | A | | 3/1996 | Smith | |
| 5,542,799 | A | | 8/1996 | Culpen | |
| 5,694,903 | A | | 12/1997 | Ganser | |
| 5,697,342 | A | * | 12/1997 | Anderson et al. | 123/446 |
| 5,720,318 | A | | 2/1998 | Nagarajan et al. | |
| 5,819,704 | A | | 10/1998 | Tarr et al. | |
| 5,820,033 | A | | 10/1998 | Cooke | |
| 5,904,300 | A | | 5/1999 | Augustin | |
| 5,979,789 | A | | 11/1999 | Sullivan et al. | |
| 6,056,264 | A | | 5/2000 | Benson et al. | |
| 6,155,503 | A | | 12/2000 | Benson et al. | |
| 6,286,768 | B1 | | 9/2001 | Vetters et al. | |
| 6,298,826 | B1 | | 10/2001 | Cotton, III | |
| 6,378,497 | B1 | | 4/2002 | Keyster et al. | |
| 6,439,202 | B1 | | 8/2002 | Carroll, III et al. | |
| 6,568,369 | B1 | * | 5/2003 | Desai et al. | 123/467 |
| 6,655,602 | B2 | | 12/2003 | Shafer et al. | |
| 6,655,610 | B2 | | 12/2003 | Bulgatz et al. | |
| 6,837,221 | B2 | | 1/2005 | Crofts et al. | |
| 6,840,268 | B2 | | 1/2005 | Kennedy et al. | |
| 6,840,500 | B2 | | 1/2005 | Dallmeyer et al. | |
| 6,997,165 | B2 | | 2/2006 | Stockner et al. | |
| 7,025,045 | B2 | | 4/2006 | Hlousek | |
| 7,156,368 | B2 | | 1/2007 | Lucas et al. | |
| 7,159,800 | B2 | | 1/2007 | Peterson, Jr. | |
| 7,309,033 | B2 | | 12/2007 | Dallmeyer | |
| 7,347,383 | B2 | | 3/2008 | Dallmeyer et al. | |
| 7,428,893 | B2 | | 9/2008 | Shinogle et al. | |
| 7,458,529 | B2 | | 12/2008 | Ricco et al. | |
| 7,658,179 | B2 | | 2/2010 | Bock et al. | |
| 7,661,410 | B1 | | 2/2010 | Fuelberth et al. | |
| 7,954,787 | B2 | | 6/2011 | Ricco et al. | |
| 8,172,161 | B2 | | 5/2012 | Biagetti | |
| 2003/0015599 | A1 | | 1/2003 | Carroll, III et al. | |
| 2005/0077394 | A1 | * | 4/2005 | Igashira et al. | 239/533.1 |
| 2008/0272214 | A1 | * | 11/2008 | Male et al. | 239/533.3 |
| 2009/0212134 | A1 | | 8/2009 | Drake et al. | |
| 2009/0236441 | A1 | | 9/2009 | Hess et al. | |
| 2009/0267008 | A1 | | 10/2009 | Lucas et al. | |
| 2010/0012753 | A1 | | 1/2010 | Corbinelli et al. | |
| 2010/0019068 | A1 | * | 1/2010 | Frasch | F02M 47/027 239/574 |
| 2010/0288239 | A1 | * | 11/2010 | Morris et al. | 123/494 |
| 2013/0112767 | A1 | * | 5/2013 | Mahmood et al. | 239/11 |
| 2013/0119166 | A1 | * | 5/2013 | Morris et al. | 239/580 |

FOREIGN PATENT DOCUMENTS

| | | | |
|---|---|---|---|
| GB | 2 351 773 | A | 1/2001 |
| JP | 2008-115738 | A | 5/2008 |
| JP | 2010-209767 | A | 9/2010 |

* cited by examiner

FUEL INJECTOR WITH INJECTION CONTROL VALVE ASSEMBLY

CROSS-REFERENCE TO RELATED APPLICATIONS

This application claims the benefit of priority to U.S. Provisional Patent Application No. 61/554,117, filed on Nov. 1, 2011, which is hereby incorporated by reference in its entirety.

TECHNICAL FIELD

This disclosure relates to control valves for fuel injectors.

BACKGROUND

A fuel injector control valve is critical to the operation of a fuel injector because it causes a nozzle valve element of a fuel injector to open and close, creating a fuel injection event. A drain circuit is important to the operation of the fuel injector control valve because the drain circuit is positioned to connect to a control volume, and the control valve is opened and closed by connecting and disconnecting the control volume to the drain circuit.

SUMMARY

This disclosure provides a fuel injector for injecting fuel at high pressure into a combustion chamber of an internal combustion engine, comprising an injector body, a nozzle valve element, a control volume, a drain circuit, and an injection control valve. The injector body includes a longitudinal axis, an outer housing, an injector cavity, a fuel delivery circuit, and an injector orifice communicating with one end of the injector cavity to discharge fuel from the fuel delivery circuit into the combustion chamber. The nozzle valve element is positioned in one end of the injector cavity adjacent the injector orifice and is movable between an open position in which fuel may flow through the injector orifice into the combustion chamber and a closed position in which fuel flow through the injector orifice is blocked. The control volume is positioned to receive a pressurized supply of fuel. The drain circuit is positioned to drain fuel from the control volume toward a low-pressure drain and the drain circuit includes an axially inward flow passage extending along the longitudinal axis toward the injector orifice. The axially inward flow passage is positioned to receive drain fuel flow from the control volume to direct drain fuel flow in a direction along the longitudinal axis toward the injector orifice. The injection control valve is positioned along the drain circuit to control fuel flow from the control volume. The injection control valve includes a valve housing, a control valve member, and an actuator positioned in the valve housing to cause movement of the control valve member between the open and closed positions. The control valve member is positioned in the valve housing to move between an open position permitting flow through the drain circuit and a closed position blocking flow through the drain circuit.

This disclosure also provides a fuel injector for injecting fuel at high pressure into a combustion chamber of an internal combustion engine, comprising an injector body, a nozzle valve element, a control volume, a drain circuit, and an injection control valve. The injector body includes a longitudinal axis, an outer housing, an injector cavity, and an injector orifice communicating with one end of the injector cavity to discharge fuel into the combustion chamber. The nozzle valve element is positioned in one end of the injector cavity adjacent the injector orifice and is movable between an open position in which fuel may flow through the injector orifice into the combustion chamber and a closed position in which fuel flow through the injector orifice is blocked. The control volume is positioned to receive a pressurized supply of fuel. The drain circuit is positioned to drain fuel from the control volume toward a low-pressure drain. The drain circuit includes an outlet port formed in the outer housing to direct fuel flowing from the control volume to outside of the injector body. The injection control valve is positioned along the drain circuit to control fuel flow from the control volume. The injection control valve includes a valve housing, a control valve member, and an actuator positioned in the valve housing to cause movement of the control valve member between the open and closed positions, the outlet port being positioned along the longitudinal axis axially between the actuator and the injector orifice. The control valve member is positioned in the valve housing to move between an open position permitting fuel flow through the drain circuit and a closed position blocking fuel flow through the drain circuit.

This disclosure also provides a fuel injector for injection fuel at high pressure into a combustion chamber of an internal combustion engine, comprising an injector body, a nozzle valve element, a control volume, a drain circuit, and an injection control valve. The injector body includes a longitudinal axis, an outer housing, an injector cavity, and an injector orifice communicating with one end of the injector cavity to discharge fuel into the combustion chamber. The nozzle valve element is positioned in one end of the injector cavity adjacent the injector orifice, the nozzle valve element is movable between an open position in which fuel may flow through the injector orifice into the combustion chamber and a closed position in which fuel flow through the injector orifice is blocked. The control volume is positioned to receive a pressurized supply of fuel. The drain circuit is positioned to drain fuel from the control volume toward a low-pressure drain. The injection control valve is positioned along the drain circuit to control fuel flow from the control volume. The injection control valve includes a valve housing, a control valve member, and an actuator positioned in the valve housing to cause movement of the control valve member between the open and closed positions. The control valve member is positioned in the valve housing to move between an open position permitting flow through the drain circuit and a closed position blocking flow through the drain circuit. The actuator includes a stator and an armature operably connected to the control valve member. The valve housing includes a valve cavity containing the actuator. The drain circuit further includes a transverse flow passage formed in the valve housing, the transverse flow passage including an upstream end positioned transversely adjacent the armature in fluid communication with the valve cavity and a downstream end in fluid communication with the low pressure drain.

This disclosure also provides an internal combustion engine, comprising an engine body, a fuel injector, and an engine drain circuit. The engine body includes a mounting bore having an inner surface sized to receive a fuel injector, a coolant passage positioned adjacent the mounting bore to receive coolant fluid, and a combustion chamber. The fuel injector is mounted in the mounting bore and includes an injector body. The injector body includes a longitudinal axis, an outer housing having an outer surface positioned adjacent the inner surface, an injector cavity, and an injector orifice communicating with one end of the injector cavity to discharge fuel into the combustion chamber. The fuel injector includes a nozzle valve element positioned in one end of the injector cavity adjacent the injector orifice, a control volume positioned to receive a pressurized supply of fuel, a drain circuit positioned within the fuel injector to drain fuel from the control volume to outside the fuel injector, and an injection control valve positioned within the injector body along the drain circuit to control fuel flow from the control volume. The injection control valve includes a valve housing, a control valve member operable to control the flow of fuel from the control volume through the drain circuit, and an actuator positioned in the valve housing to cause movement of the control valve member. The engine drain circuit includes an axial drain passage positioned between the inner surface of the mounting bore and the fuel injector to receive fuel drain flow from the drain circuit. The axial drain passage is positioned in an overlapping side-by-side relationship with the coolant passage for at least a portion of the axial drain passage, and the axial drain passage is axially positioned between the actuator and the injector orifice.

Advantages and features of the embodiments of this disclosure will become more apparent from the following detailed description of exemplary embodiments when viewed in conjunction with the accompanying drawings.

DETAILED DESCRIPTION

Figure 1:
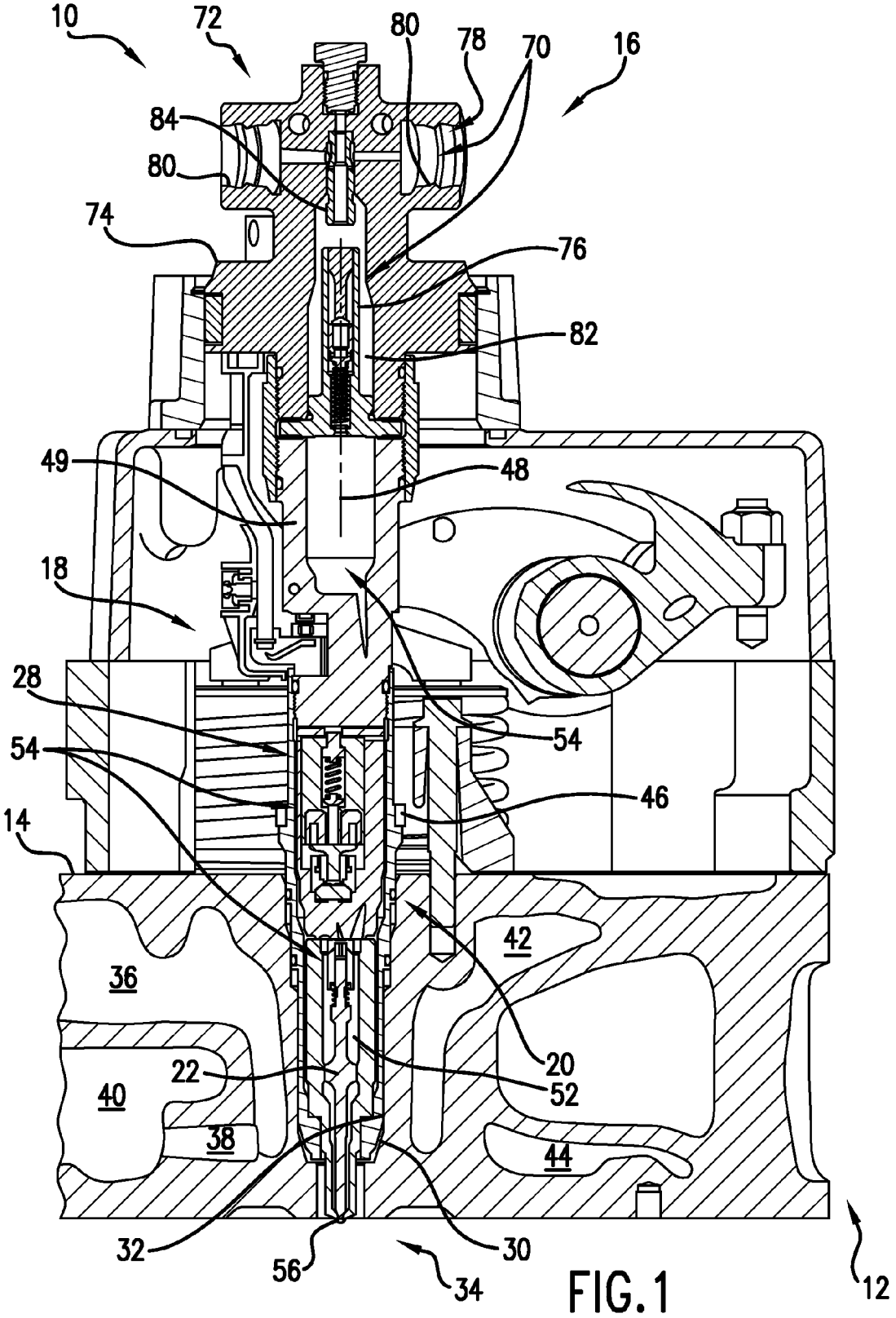
FIG. 1 is a cross-sectional view of a portion of an internal combustion engine.

Referring to FIG. 1, a portion of an internal combustion engine is shown generally indicated at 10. Engine 10 includes an engine body 12, which includes an engine block (not shown) and a cylinder head 14 attached to the engine block. Engine 10 also includes a fuel system 16 that includes one or more fuel injectors 18, a fuel pump, a fuel accumulator, valves, and other elements (not shown) that connect to fuel injector 18.

Figure 2:
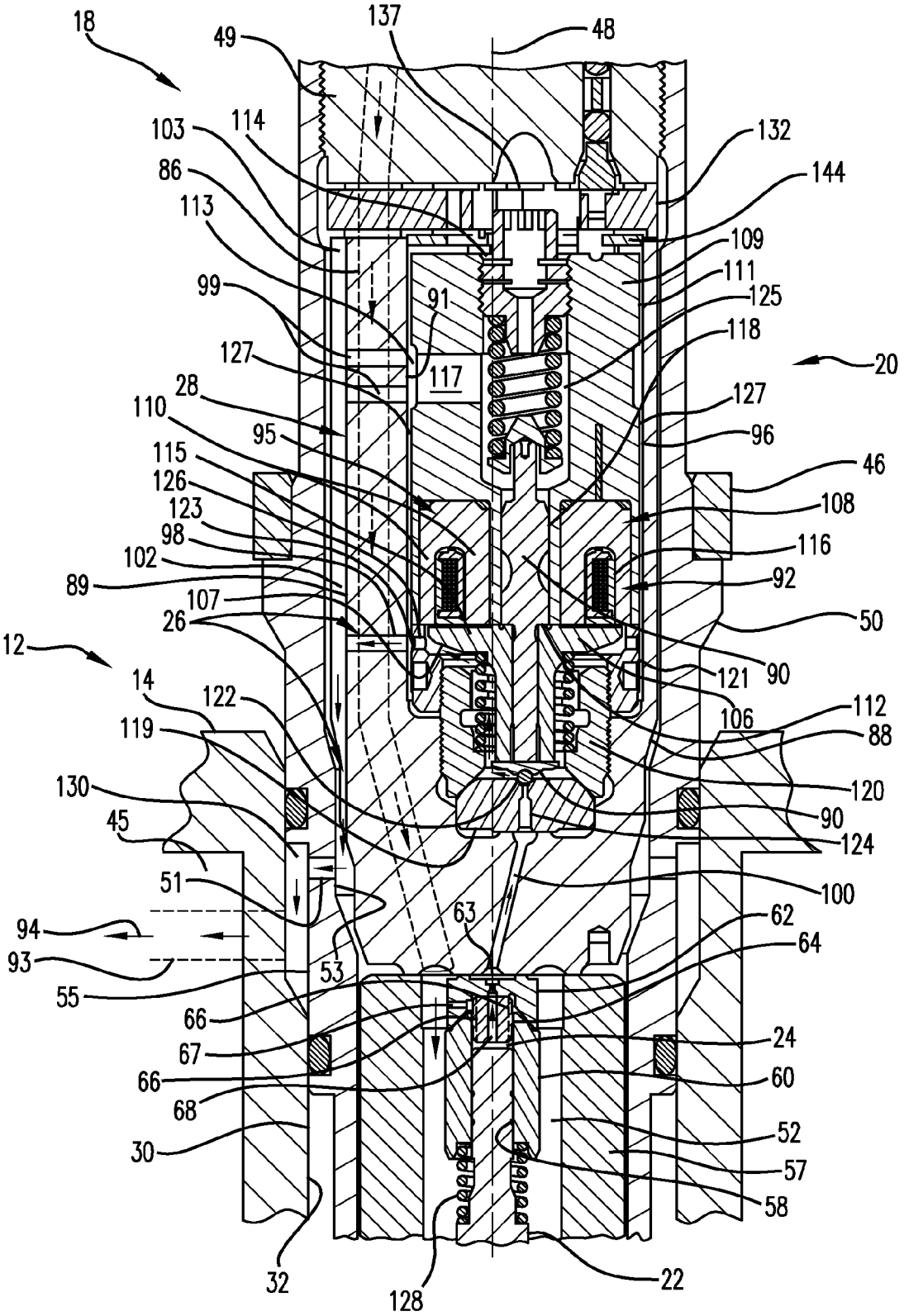
FIG. 2 is a cross-sectional view of a portion of the internal combustion engine of FIG. 1, showing a first exemplary embodiment of the present disclosure.
Figure 3:
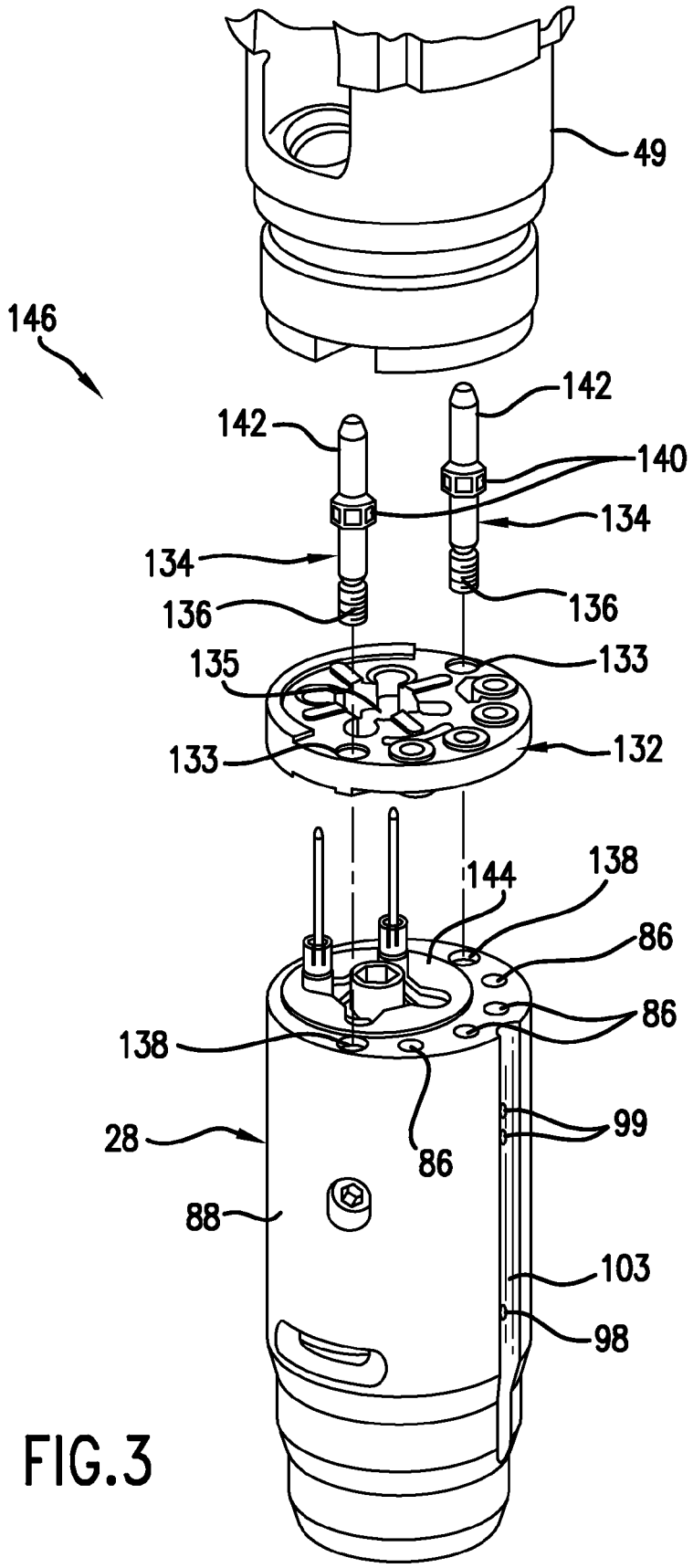
FIG. 3 is a perspective view of a control valve cartridge assembly of FIG. 2.

Referring to FIGS. 1-3, fuel injector 18 includes an injector body 20, a nozzle valve element 22, a control volume 24, a drain circuit 26, and an injection control valve assembly 28.

Applicants recognized that one challenge with drain circuits is that they carry hot fuel and the compact nature of fuel injectors causes the hot fuel to flow in undesirable areas, such as in proximity to an actuator of the fuel injector, which contains temperature sensitive components. While this configuration may provide design simplicity, this configuration also subjects temperature sensitive components such as the insulation of a solenoid coil and potting material around the solenoid coil to undesirably high temperatures. This issue is especially true in injectors having a servo-controlled nozzle valve element, such as in the exemplary embodiment of the present disclosure, wherein a control volume positioned adjacent an outer end of the nozzle valve element directs hot fuel to the drain circuit for draining fuel from the control volume to a low-pressure drain, and an injection control valve positioned along the drain circuit controls movement of the nozzle valve element between open and closed positions. Opening of the injection control valve causes a reduction in the fuel pressure in the control volume resulting in a pressure differential, which forces the nozzle valve element open, and closing of the injection control valve causes an increase in the control volume pressure and closing of the nozzle valve element. As will be seen, drain circuit 26 and injection control valve assembly 28 in accordance with a first exemplary embodiment of the present disclosure include features that reduce heat transfer from fuel flowing through drain circuit 26 to temperature sensitive portions of fuel injector 18, improving the life and performance of fuel injector 18.

Engine body 12 includes a mounting bore 30 formed by an inner wall or surface 32, sized to receive fuel injector 18, and a clamp assembly 46 for securing fuel injector 18 in mounting bore 30. Engine body 12 also includes a combustion chamber 34 and one or more coolant passages 36, 38, 40, 42, 44 and 45 arranged about mounting bore 30 and along combustion chamber 34 to provide cooling to fuel injector 18 and components surrounding or adjacent combustion chamber 34. Combustion chamber 34, only a portion of which is shown in FIG. 1, is positioned in a known manner in engine body 12, between cylinder head 14 and the engine block (not shown). At least a portion of at least one coolant passage, e.g., coolant passages 36 and 42, extend in a longitudinal direction in a portion of cylinder head 14 alongside or adjacent mounting bore 30. At least a portion of at least one coolant passage, e.g., coolant passages 38 and 44, extend generally transverse to mounting bore 30 in a portion of cylinder head 14 that is at least partially alongside combustion chamber 34. Engine body 12 further includes a low-pressure engine drain circuit 94 including an engine drain passage 93 connected to a low-pressure drain, e.g., an engine fuel sump.

Throughout this specification, inwardly, distal, and near are longitudinally in the direction of combustion chamber 34. Outwardly, proximate, and far are longitudinally away from the direction of combustion chamber 34.

Injector body 20 includes a longitudinal axis 48 extending along the length of injector body 20, an upper body or barrel portion 49, an outer housing or retainer 50, a nozzle housing 57 positioned in outer housing 50, and an injector cavity 52 located within nozzle housing 57. Injector body 20 further includes a fuel delivery circuit 54, one or more injector orifices 56 positioned at a distal end of outer housing 50, and an upper cavity 137 positioned between control valve assembly 28 and barrel portion 49. Injector orifice(s) 56 communicate with one end of injector cavity 52 to discharge fuel from fuel delivery circuit 54 into combustion chamber 34. In addition to locating the elements of fuel injector 18, outer housing 50 includes an interior surface 53, an exterior surface 55, and a transversely or radially extending outlet port 51 positioned between interior surface 53 and exterior surface 55.

Nozzle valve element 22 is positioned in one end of injector cavity 52 adjacent injector orifice 56. Nozzle valve element 22 is movable between an open position in which fuel may flow through injector orifice 56 into combustion chamber 34 and a closed position in which fuel flow through injector orifice 56 is blocked.

Nozzle valve element 22 extends into a nozzle element cavity 58 formed within a nozzle element guide 60. Control volume 24 is formed between an end of nozzle valve element 22 and an interior of nozzle element guide 60. Nozzle element guide 60 includes a proximal cap or end portion 62 and a control volume plug 64. End portion 62 of nozzle element guide 60 forms control volume 24 when end portion 62 and nozzle element guide 60 are mounted in injector cavity 52. Control volume plug 64 is mounted within nozzle element cavity 58 in a location adjacent to end portion 62. End portion 62 includes an end portion passage 63 that extends longitudinally through end portion 62 and one or more transverse end portion passages 67. Control volume plug 64 includes a plurality of longitudinal plug channels or passages 66 located about a periphery of control volume plug 64 and a longitudinally extending central passage 68. Control volume 24 receives high-pressure fuel from injector cavity 52 by way of transverse end portion passage 67 and plug passage 66. Central passage 68 is positioned to connect control volume 24 to end portion passage 63.

The pressure of fuel in control volume 24 determines whether nozzle valve element 22 is in an open position or a closed position, which is further determined by injection control valve assembly 28, described in more detail hereinbelow. When nozzle valve element 22 is positioned in injector cavity 52, nozzle element guide 60, and more specifically, end portion 62 of nozzle element guide 60, is positioned longitudinally between nozzle valve element 22 and injection control valve assembly 28. Other servo controlled nozzle valve assemblies may be used, such as those disclosed in U.S. Pat. No. 6,293,254, the entire content of which is hereby incorporated by reference.

A flow limiter assembly 72 may be positioned at a proximate end of fuel injector 18 and flow limiter assembly 72 may include a limiter outer housing 74 and a flow limiter sub-assembly 76. An inlet fuel circuit 70 extends through limiter outer housing 74 of flow limiter assembly 72 to connect fuel system 16 with fuel delivery circuit 54. Limiter outer housing 74 includes a high-pressure inlet 78, one or more bosses 80, and a housing recess or bore portion 82 into which a portion of flow limiter sub-assembly 76 extends. High-pressure inlet 78 may be connected to a fuel rail or accumulator (not shown), or may be a part of a daisy chain arrangement wherein other fuel injectors may be connected via appropriate high-pressure lines to, for example, bosses 80 integrally formed in limiter outer housing 74, either upstream or downstream of high-pressure inlet 78. Inlet fuel circuit 70 extends from high-pressure inlet 78 through limiter outer housing 74 and through flow limiter sub-assembly 76 to connect with fuel delivery circuit 54. Flow limiter assembly 72 may include a pulsation dampener 84 positioned along inlet fuel circuit 70, which serves to reduce transmission of pulsation waves, caused by injection events, between fuel injectors.

Fuel delivery circuit 54 is positioned to connect high-pressure fuel from inlet fuel circuit 70 to injector cavity 52 and control volume 24. Fuel delivery circuit 54 includes a plurality of longitudinally extending fuel delivery passages 86 extending through injection control valve assembly 28 to provide high-pressure fuel to injector cavity 52 and control volume 24. Injection control valve assembly 28 is positioned along drain circuit 26 and includes a valve housing 88 having a valve cavity 96 formed by a valve housing interior surface 91, and a fuel injector control valve 95 positioned within valve cavity 96. Injector control valve 95 includes a control valve member 90 and an actuator 92 positioned in valve housing 88 to cause movement of control valve member 90 between the open and closed positions. Control valve member 90 is positioned in valve cavity 96 to move reciprocally between an open position permitting flow through drain circuit 26 and a closed position blocking flow through drain circuit 26. Actuator 92 includes a solenoid assembly 108 that includes a stator housing 109 having a first end 112 and a second end 114, a stator 110 positioned in stator housing 109, a coil 116 positioned circumferentially in and around stator 110, and an armature 106 operably connected to control valve member 90. Stator housing 109 includes a stator housing exterior surface 111, a central aperture, bore or core 118 extending through stator housing 109 from first end 112 to second end 114, and a transversely extending stator passage 117. Central aperture 118 includes a spring cavity 125 and is positioned to receive control valve member 90. An annular stator housing passage 113 is formed between valve housing interior surface 91 and exterior surface 111 of stator housing 109. In the exemplary embodiment, annular stator housing passage 113 is formed on exterior surface 111 of stator housing 109. An annular gap 127 exists between exterior surface 111 of stator housing 109 and valve housing interior surface 91. Annular gap 127 permits air to travel between stator housing 109 and valve housing 88 to upper cavity 137 where the air remains or is dissolved into solution with the drain fuel over time.

Injection control valve assembly 28 also includes a seat portion 119, a seat retainer 120, and an adjusting ring 121 positioned in a distal end of valve cavity 96. Seat portion 119 includes a control valve seat 122 and a longitudinally extending seat portion passage 124. Adjusting ring 121 includes a plurality of radially or transversely extending adjusting ring passages 126. An annular groove 123 may be formed between an exterior of adjusting ring 121 and interior surface 91 of valve housing 88. In the exemplary embodiment, annular groove 123 is formed on an exterior of adjusting ring 121. Adjusting ring 121 is sized, positioned, and adjusted to space armature 106 an axial distance from stator 110 and coil 116 along longitudinal axis 48.

As best seen in FIG. 3, injection control valve assembly 28 may also include a cover plate 132, which includes openings 133, retainers 134, and central opening 135. Retainers 134 include threads 136 formed at a first or distal end of retainers 134, an interface portion 140, and a pin portion 142. Valve housing 88 includes threaded recesses 138 having threads that mate with threads 136. The first or distal end of retainers 134 extend through openings 133 formed in cover plate 132 to engage with threaded recesses 138. Interface portion 140 is shaped to mate with an adjusting tool (not shown) that permits retainers 134 to be tightened securely to valve housing 88. Once cover plate 132 is secured to valve housing 88 by retainers 134, the components positioned in valve cavity 96, including control valve member 90, actuator 92, seat portion 119, seat retainer 120, and adjusting ring 121, are secured within valve housing 88 to form a self-contained valve cartridge assembly 146. Valve cartridge assembly 146 may include a bias spring 144 positioned between stator housing 109 and cover plate 132 to position the fixed elements of valve cartridge assembly 146 in an abutting relationship when cover plate 132 is secured to valve housing 88. Because injection control valve cartridge assembly 146 is formed as a single integrated unit or a complete assembly, it may be easily installed or inserted within outer housing 50. Barrel portion 49 contains recesses (not shown) that mate with pin portion 142 to provide proper orientation of barrel 49 with cartridge assembly 146.

Valve housing 88 includes a transversely or radially extending flow passage 98 connecting valve cavity 96 to an exterior of valve housing 88, a longitudinally extending first drain passage 100, and one or more relief passages 99. A longitudinally or axially inwardly extending flow passage 102 is provided to connect transversely extending passage 98 to outlet port 51. Inward flow passage 102 is formed between an exterior surface 89 of valve housing 88 and interior surface 53 of outer housing 50. In the exemplary embodiment, flow passage 102 includes an axial groove 103 formed in valve housing 88. Valve housing 88 also includes axially extending fuel delivery passage(s) 86, which are part of fuel delivery circuit 54. Axially inward flow passage 102 is positioned circumferentially adjacent to at least one fuel delivery passage 86, and may be positioned circumferentially adjacent to two fuel delivery passages 86. Transverse flow passage 98 is positioned a spaced circumferential distance from axially extending fuel delivery passages 86. Thus, transverse flow passage 98 extends between two adjacent fuel delivery passages 86, as best seen in FIG. 3. Transverse flow passage 98 is also positioned longitudinally in a location that is transversely adjacent to actuator 106, and, more specifically, is transversely or radially adjacent to the portion of valve cavity 96 that is adjacent armature 106, and more specifically, a distal surface 107 of armature 106. Because fuel injector 18 is typically operated in the orientation shown in FIG. 1, transverse flow passage 98 is also adjacent a portion of valve cavity 96 that is below or under distal surface 107 of armature 106. First drain passage 100 is positioned to connect injector cavity 52 to valve cavity 96.

Drain circuit 26 extends from control volume 24 through injection control valve assembly 28, through outer housing 50 into mounting bore 30, to engine drain passage 93 of low-pressure engine drain circuit 94. More specifically, drain circuit 26 includes central passage 68, end portion passage 63, first drain passage 100, seat portion passage 124, valve cavity 96, adjusting ring passage 126, annular groove 123, transverse flow passage 98, axially inward flow passage 102, and outlet port 51. Outlet port 51 is positioned longitudinally between injector orifice 56 and actuator 92, and may be positioned longitudinally between injector orifice 56 and control valve member 90. When fuel injector 18 is positioned in mounting bore 30, outer or exterior surface 55 of outer housing 50 is positioned adjacent to inner surface 32 of mounting bore 30, and an axially extending drain passage 130 is formed by exterior surface 55 of outer housing 50 and inner surface 32 of mounting bore 30. As described further hereinbelow, axial drain passage 130 is included as a part of drain circuit 26. Axial drain passage 130 overlaps at least one engine body coolant passage, e.g., coolant passage 45, in an axial direction, which means that axial drain passage 130 and coolant passage 45 are side-by-side or radially adjacent for at least a portion of axial drain passage 130. Axial drain passage 130 is positioned longitudinally between actuator 92 and injector orifice 56. More specifically, axial drain passage 130 extends longitudinally from outlet port 51 to a location adjacent engine drain passage 93 to permit fluid communication between outlet port 51 and engine drain passage 93.

When injector control valve 95 is energized by an engine control system (not shown), actuator 92 is operable to move armature 106 longitudinally toward stator 110. Movement of armature 106 causes control valve member 90 to move longitudinally away from control valve seat 122, which causes drain circuit 26 to be connected with control volume 64. Fuel is immediately able to flow outwardly through central passage 68, end portion passage 63, first drain passage 100, and seat portion passage 124. Fuel then flows between control valve member 90 and control valve seat 122 and into valve cavity 96. The fuel in valve cavity 96 continues to flow longitudinally outward toward and then transversely through adjusting ring passage 126. Because adjusting ring 121 is movable to establish the position of stator housing 109, adjusting ring passage 126 may be misaligned with transverse flow passage 98. Annular groove 123 permits fuel to flow from adjusting ring passage 126 to transverse flow passage 98, regardless of the position of adjusting ring passages 126 with respect to transverse flow passage 98. Transverse flow passage 98 is in fluid communication with valve cavity 96 at an upstream or first end and axially inward flow passage 102, and thus engine drain passage 93 of low-pressure drain 94, at a downstream or second end, receiving fuel flow from valve cavity 96 by way of adjusting ring passage 126. The first end of transverse flow passage 98 opens into valve cavity 96 in a location that is radially adjacent to armature 106, and more specifically, to distal surface 107 of a transverse portion 115 of armature 106. The fuel flows radially or transversely through adjusting ring passage 126, into annular groove 123, and into transversely extending passage 98, moving from valve cavity 96 into axially inward flow passage 102.

Because drain fuel flows directly from valve cavity 96 to axially inward flow passage 102 by way of transversely extending passage 98, the hot drain fuel is directed away from solenoid assembly 108, reducing the heat transferred from the hot drain fuel to solenoid assembly 108. In addition to reducing heat transfer to solenoid assembly 108, location of transversely extending passage 98 is advantageous in that the drain fuel is able to carry air and debris away from components such as armature 106 and stator 110, potentially improving the reliability and durability of these components. Additionally, since transverse flow passage 98 is positioned circumferentially adjacent or between fluid delivery passage 86, there is some heat transfer from the hot drain fuel to the cooler fuel in fluid delivery passages 86, providing cooling to the hot drain fuel. Once in axially inward flow passage 102, fuel flows longitudinally or axially inwardly in a direction that is toward outlet port 51, where the fuel flows into outlet port 51. Axial drain passage 130 receives the drain fuel from outlet port 51, directing the drain fuel longitudinally or axially inwardly in a direction that is toward the distal end of fuel injector 18, which is toward injector orifices 56. The fuel then flows into engine drain passage 93 of low-pressure engine drain circuit 94. Thus, drain circuit 26 is positioned to receive drain fuel from control volume 24 and to drain the fuel toward low-pressure engine drain circuit 94.

With connection of control volume 24 to engine drain circuit 94, fuel pressure in control volume 24 is significantly reduced in comparison to fuel pressure in injector cavity 52. The pressure on the distal end of nozzle valve element 22 is significantly greater than the pressure on the proximate end of nozzle valve element 22, forcing nozzle valve element 22 longitudinally away from injector orifices 56, and permitting high-pressure fuel to flow from injector cavity 52 into combustion chamber 34. When actuator 92 is de-energized, control valve member 90 is biased by springs to cause injector control valve 95 to close. When injector control valve 95 is closed, pressure builds in control volume 24, causing, in combination with a nozzle element bias spring 128, nozzle valve element 22 to move longitudinally toward injector orifices 56, closing or blocking injector orifices 56.

The benefit of drain circuit 26 is that hot fuel flowing through drain circuit 26 is moved out from valve cavity 96 prior to reaching temperature sensitive solenoid assembly 108, and especially temperature sensitive coil 116, which includes temperature sensitive insulation and potting material. In previous fuel injector designs, hot fuel in the drain circuit flows past the actuator, including electrical components such as coil 116, subjecting these components to unnecessary and potentially damaging heat. By redirecting drain flow away from actuator 92, the life and reliability of actuator 92, and particularly coil 116, may be improved, resulting in improved life for fuel injector 18. Additionally, since drain circuit 26 extends past coolant passage 45, the fuel flowing through drain circuit 26 is beneficially cooled prior to returning to fuel system 16.

During operation, control valve member 90 moves up and down, causing a pumping action to occur in spring cavity 125. Stator passage 117 is positioned to connect spring cavity 125 to annular gap 127 and to one or more relief passages 99 formed in valve housing 88, thus providing an unrestricted venting of spring cavity 125, which allows unencumbered movement of control valve member 90.

Figure 4:
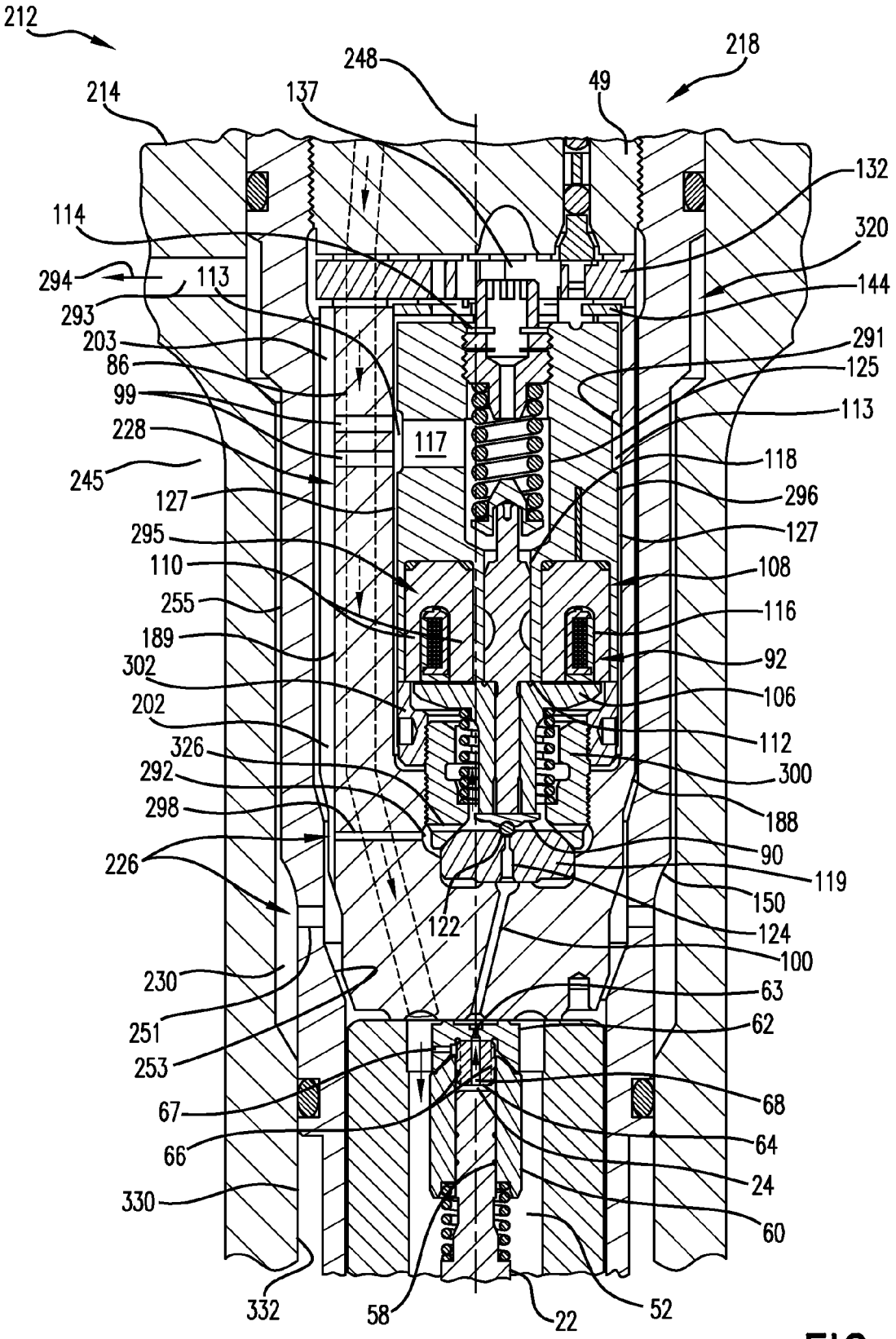
FIG. 4 is a cross-sectional view similar to FIG. 2, showing a second exemplary embodiment of the present disclosure.

Referring to FIG. 4, a second exemplary embodiment fuel injector 218 in accordance with the present disclosure is shown. Items in this embodiment that have the same number in the first exemplary embodiment are as described in the first exemplary embodiment. Fuel injector 218 is positioned in a mounting bore 330 formed in a cylinder head 214 of an engine body 212, which are functionally similar to mounting bore 30, engine body 12, and cylinder head 14, but are structurally different from the latter elements. Fuel injector 218 includes an injector body 320, nozzle valve element 22, control volume 24, a drain circuit 226, and an injection control valve assembly 228. As will be seen, drain circuit 226 and injection control valve assembly 228 in accordance with the second exemplary embodiment of the present disclosure include features that reduce heat transfer from fuel flowing through drain circuit 226 to temperature sensitive portions of fuel injector 218, improving the life and performance of fuel injector 218. Injection control valve assembly 228 may be configured as an integrated or self-contained cartridge assembly, as described in the previous embodiment.

Engine body 212 includes mounting bore 330 formed by an inner wall or surface 332, sized to receive fuel injector 218. Engine body 212 also includes at least one coolant passage 245 arranged about mounting bore 330 to provide cooling to fuel injector 218. Engine body 212 further includes a low-pressure engine drain circuit 294 including an engine drain passage 93 connected to a low-pressure drain, e.g., an engine fuel sump.

Injector body 320 includes a longitudinal axis 248 extending along the length of injector body 320, an outer housing or retainer 150, and injector cavity 52 located within outer housing 150. Though not shown in FIG. 4, fuel injector 218 includes injector orifices 56 positioned at a distal end of outer housing 150, as shown for fuel injector 18 in FIG. 2. Fuel injector 218 also includes fuel delivery circuit 54, as shown in FIG. 1. Injector orifice(s) 56 communicate with one end of injector cavity 52 to discharge fuel from fuel delivery circuit 54 into combustion chamber 34. In addition to locating the elements of fuel injector 218, outer housing 150 includes an interior surface 253, an exterior surface 255, and a transversely or radially extending outlet port 251 positioned between interior surface 253 and exterior surface 255.

Nozzle valve element 22 is as described in the first embodiment, and is described in this embodiment only to the extent necessary for clarity. Nozzle valve element 22 extends into nozzle element cavity 58 formed within nozzle element guide 60. Control volume 24 is formed between the end of nozzle valve element 22 and the interior of nozzle element guide 60. Nozzle element guide 60 is as described in the first exemplary embodiment.

Fuel delivery circuit 54 is positioned to connect high-pressure fuel from inlet fuel circuit 70 to injector cavity 52 and control volume 24. Fuel delivery circuit 54 includes a plurality of longitudinally or axially extending fuel delivery passages 86 extending through injection control valve assembly 228 to provide high-pressure fuel to control volume 24.

Injection control valve assembly 228 is positioned along drain circuit 226 and includes a valve housing 188 having a valve cavity 296 formed by a valve housing interior surface 291, and a fuel injector control valve 295. Injector control valve 295 includes a control valve member 90 and actuator 92 positioned in valve housing 188 to cause movement of control valve member 90 between the open and closed positions. Control valve member 90 is positioned in valve cavity 296 to move reciprocally between an open position permitting flow through drain circuit 226 and a closed position blocking flow through drain circuit 226. Actuator 92 includes armature 106 operably connected to control valve member 90, solenoid assembly 108 that includes stator housing 109 having first end 112 and second end 114, stator 110 positioned in stator housing 109, and coil 116 positioned circumferentially in stator 110. Stator housing 109 is as described in the first embodiment.

Injection control valve assembly 228 includes seat portion 119, a seat retainer 300, and an adjusting ring 302 positioned in a distal end of valve cavity 296. Seat portion 119 includes control valve seat 122 and longitudinally extending seat portion passage 124. Seat retainer 300 includes a plurality of radially or transversely extending retainer passages 326. An annular groove or passage 292 may be formed between an exterior of seat retainer 300 and valve housing interior surface 291. In the exemplary embodiment, annular groove 292 is formed in valve housing 188. Adjusting ring 302 is sized, positioned, and adjusted to space armature 106 an axial distance from stator 110 and coil 116 along longitudinal axis 248.

Valve housing 188 includes a transversely or radially extending passage 298 connecting valve cavity 296 to an exterior of valve housing 188, longitudinally extending first drain passage 100, and one or more relief passages 99. A longitudinally inwardly extending flow passage 202 is provided to connect transversely extending passage 298 to outlet port 251. Inward flow passage 202 is formed between an exterior surface 189 of valve housing 188 and interior surface 253 of outer housing 150. In the second exemplary embodiment, flow passage 202 includes an axial groove 203 formed in valve housing 188. Valve housing 188 also includes axially extending fuel delivery passage(s) 86, which are part of fuel delivery circuit 54. Axially inward flow passage 202 is positioned circumferentially adjacent to at least one fuel delivery passage 86, and may be positioned circumferentially adjacent to two fuel delivery passages 86. Transverse flow passage 298 is longitudinally in a location that is transversely or radially adjacent to seat portion 119 and to a distal end of seat retainer 300, and is positioned a spaced circumferential distance from axially extending fuel delivery passages 86. Thus, transverse flow passage 298 extends between two adjacent fuel delivery passages 86, similar to the configuration shown for transverse flow passage 98 shown in FIG. 3. First drain passage 100 is positioned to connect injector cavity 52 to valve cavity 296.

Drain circuit 226 extends from control volume 24 through injection control valve assembly 228, through outer housing 150 into mounting bore 330, to low-pressure engine drain circuit 294. More specifically, drain circuit 226 includes central passage 68, end portion passage 63, first drain passage 100, seat portion passage 124, valve cavity 296, retainer passages 326, annular groove or passage 292, transverse flow passage 298, axially inward flow passage 202, and outlet port 251. Outlet port 251 is positioned in a location longitudinally between injector orifice 56 and actuator 92. When fuel injector 218 is positioned in mounting bore 330, outer or exterior surface 255 of outer housing 150 is positioned adjacent to inner surface 332 of mounting bore 330, and an axially extending drain passage 230 is formed by exterior surface 255 of outer housing 150 and inner surface 332 of mounting bore 330. As described further hereinbelow, axial drain passage 230 is included as a part of drain circuit 226. Axial drain passage 230 overlaps at least one engine body coolant passage, e.g., coolant passage 245, in an axial direction, which means that axial drain passage 230 and coolant passage 245 are side-by-side or adjacent for at least a portion of axial drain passage 230. Axial drain passage 230 extends from a position that is longitudinally between actuator 92 and injector orifice 56 outwardly to engine drain passage 293.

When injector control valve 295 is energized by an engine control system (not shown), actuator 92 is operable to move armature 106 and thus control valve member 90 longitudinally toward stator 110. Movement of control valve member 90 longitudinally toward stator 110 and coil 116 is simultaneously movement away from control valve seat 122, which connects drain circuit 226 with control volume 64. Fuel is immediately able to flow outwardly through central passage 68, end portion passage 63, first drain passage 100, and seat portion passage 124. Fuel then flows between control valve member 90 and control valve seat 122 and into valve cavity 296. The fuel in valve cavity 296 continues to flow longitudinally outward toward and through retainer passages 326. Because seat retainer 300 is movable to secure seat portion 119, retainer passages 326 may be misaligned with transverse flow passage 226. Annular groove 292 permits fuel to flow from retainer passages 326 to transverse flow passage 298, regardless of the position of retainer passages 326 with respect to transverse flow passage 298. Transverse flow passage 298 is in fluid communication with valve cavity 296 at an upstream or first end and axially inward flow passage 202 at a downstream or second end, and thus engine drain passage 293 of low-pressure drain circuit 294, receiving fuel flow from valve cavity 296 by way of retainer passages 326. The first end of transverse flow passage 298 opens into valve cavity 296 in a location that is radially or transversely adjacent the distal end of seat retainer 300 and seat portion 119. The fuel flows radially or transversely through retainer passages 326 and into transversely extending passage 298, moving from valve cavity 296 into axially inward flow passage 202. Once in axially inward flow passage 202, fuel flows longitudinally or axially inwardly in a direction that is toward outlet port 251, flowing through outlet port 251 into axial drain passage 230. Once in axial drain passage 230, fuel flows longitudinally or axially outwardly in a direction that is away from the distal end of fuel injector 218, which is away from injector orifices 56. The fuel then flows into engine drain passage 293 of low-pressure engine drain circuit 294. As with the previous embodiment, the flow of fuel is away from the temperature sensitive components of solenoid assembly 108.

With connection of control volume 24 to engine drain circuit 294, fuel pressure in control volume 24 is significantly reduced in comparison to fuel pressure in injector cavity 52. The pressure on the distal end of nozzle valve element 22 is significantly greater than the pressure on the proximate end of nozzle valve element 22, forcing nozzle valve element 22 longitudinally away from injector orifices 56, and permitting high-pressure fuel to flow from injector cavity 52 into combustion chamber 34. When actuator 92 is de-energized, control valve member 90 is biased by springs to cause injection control valve assembly 228 to close. When injection control valve assembly 228 is closed, pressure builds in control volume 24, causing, in combination with a nozzle element bias spring 128, nozzle valve element 22 to move longitudinally toward injector orifices 56, closing or blocking injector orifices 56.

The benefit of drain circuit 226 is that hot fuel flowing through drain circuit 226 is moved out from valve cavity 296 prior to reaching temperature sensitive actuator 92, and especially temperature sensitive coil 116. In previous fuel injector designs, hot fuel in the drain circuit flows past the stator, including electrical components such as coil 116, subjecting these components to unnecessary and potentially damaging heat. By redirecting drain flow away from solenoid assembly 108, the life and reliability of solenoid assembly 108, and particularly coil 116, may be improved, resulting in improved life for fuel injector 218. Additionally, since drain circuit 226 extends past fuel delivery passages 86 and coolant passage 245, the fuel flowing through drain circuit 226 is beneficially cooled prior to returning to fuel system 16.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A fuel injector for injecting fuel at high pressure into a combustion chamber of an internal combustion engine, comprising:

an injector body including a longitudinal axis, an outer housing, an injector cavity, a fuel delivery circuit, and an injector orifice communicating with one end of the injector cavity to discharge fuel from the fuel delivery circuit into the combustion chamber;

a nozzle valve element positioned in one end of the injector cavity adjacent the injector orifice, the nozzle valve element movable between an open position in which fuel may flow through the injector orifice into the combustion chamber and a closed position in which fuel flow through the injector orifice is blocked;

a control volume positioned to receive a pressurized supply of fuel;

a drain circuit positioned to drain fuel from the control volume toward a low pressure drain, the drain circuit including an axially inward flow passage extending the longitudinal axis toward the injector orifice and positioned to receive drain fuel flow from the control volume to direct drain fuel flow in a direction along the longitudinal axis toward the injector orifice, and the drain circuit including a transverse flow passage including a first end and a second end; and an injection control valve assembly positioned along the drain circuit to control fuel flow from the control volume, the injection control valve assembly including a valve housing having a valve cavity including an actuator, a fuel injector control valve positioned within the valve cavity, a control valve member positioned in the valve cavity to move between an open position permitting flow through the drain circuit and a closed position blocking flow through the drain circuit, and an actuator positioned in the valve cavity to cause movement of the control valve member between the open and closed positions, wherein the first end of the transverse flow passage is in fluid communication with the valve cavity and the second end of the transverse flow passage is in fluid communication with the axially inward flow passage and the first end, and the actuator includes a stator and an armature operably connected to the control valve member, the first end of the transverse flow passage opening into the valve cavity radially adjacent a portion of the valve cavity that is under a distal surface of the armature.

2. The fuel injector of claim 1, wherein the drain circuit further includes an outlet port formed in the outer housing to direct fuel outside of the injector body.

3. The fuel injector of claim 2, wherein the outlet port is positioned along the longitudinal axis axially between the actuator and the injector orifice.

4. The fuel injector of claim 2, wherein the outlet port is positioned along the longitudinal axis axially between the control valve member and the injector orifice.

5. The fuel injector of claim 1, the actuator including an armature and wherein the transverse flow passage, including the first end and the second end, is positioned along the longitudinal axis in a location transversely adjacent the armature.

6. The fuel injector of claim 1, wherein the axially inward flow passage is formed between an outer surface of the valve housing and an inner surface of the outer housing.

7. The fuel injector of claim 1, wherein the fuel delivery circuit includes a delivery passage extending axially within the valve housing and the axially inward flow passage is located at a position circumferentially adjacent the delivery passage.

8. A fuel injector for injecting fuel at high pressure into a combustion chamber of an internal combustion engine, comprising:

an injector body including a longitudinal axis, an outer housing, an injector cavity, and an injector orifice communicating with one end of the injector cavity to discharge fuel into the combustion chamber;

a nozzle valve element positioned in one end of the injector cavity adjacent the injector orifice, the nozzle valve element movable between an open position in which fuel may flow through the injector orifice into the combustion chamber and a closed position in which fuel flow through the injector orifice is blocked;

a control volume positioned to receive a pressurized supply of fuel;

an injection control valve assembly positioned along the drain circuit to control fuel flow from the control volume, the injection control valve including a valve housing having a valve cavity, a fuel injector control valve positioned within the valve cavity, a control valve member positioned in the valve cavity to move between an open position permitting fuel flow through the drain circuit and a closed position blocking fuel flow through the drain circuit, and an actuator positioned in the valve cavity to cause movement of the control valve member between the open and closed positions, the outlet port being positioned along the longitudinal axis axially between the actuator and the injector orifice; and a drain circuit positioned to drain fuel from the control volume toward a low pressure drain, the drain circuit including an outlet port formed in the outer housing to direct fuel flowing from the control volume to outside of the injector body, an axially inward flow passage formed between an exterior of the valve housing and an interior of the outer housing, and a transverse flow passage formed in the valve housing and including a first end in fluid communication with the valve cavity and a second end in fluid communication with the axially inward flow passage.

9. The fuel injector of claim 8, wherein the outlet port is positioned along the longitudinal axis axially between the control valve member and the injector orifice.

10. The fuel injector of claim 8, the actuator including an armature and wherein the transverse flow passage, including the first end and the second end, is positioned along the longitudinal axis in a location transversely adjacent the armature.

11. The fuel injector of claim 8, wherein the actuator includes an armature operably connected to the control valve member, the first end of the transverse flow passage opening into the valve cavity radially adjacent a portion of the valve cavity that is under a distal surface of armature.

12. A fuel injector for injecting fuel at high pressure into a combustion chamber of an internal combustion engine, comprising:

an injector body including a longitudinal axis, an outer housing, an injector cavity, and an injector orifice communicating with one end of the injector cavity to discharge fuel into the combustion chamber;

a nozzle valve element positioned in one end of the injector cavity adjacent the injector orifice, the nozzle valve element movable between an open position in which fuel may flow through the injector orifice into the combustion chamber and a closed position in which fuel flow through the injector orifice is blocked;

a control volume positioned to receive a pressurized supply of fuel;

a drain circuit positioned to drain fuel from the control volume toward a low-pressure drain; and an injection control valve positioned along the drain circuit to control fuel flow from the control volume, the injection control valve including a valve housing, a control valve member positioned in the valve housing to move between an open position permitting flow through the drain circuit and a closed position blocking flow through the drain circuit, and an actuator positioned in the valve housing to cause movement of the control valve member between the open and closed positions, the actuator including a stator and an armature operably connected to the control valve member, the valve housing including a valve cavity containing the actuator, the drain circuit further including a transverse flow passage formed in the valve housing and extending perpendicularly to the longitudinal axis of the injector body, the transverse flow passage including an upstream end positioned transversely adjacent the armature in fluid communication with the valve cavity and a downstream end in fluid communication with the low pressure drain.

13. The fuel injector of claim 12, the drain circuit including an outlet port formed in the outer housing to direct fuel flowing from the control volume to outside of the injector body, the outlet port being positioned along the longitudinal axis axially between the actuator and the injector orifice.

14. The fuel injector of claim 12, wherein the outlet port is positioned along the longitudinal axis axially between the control valve member and the injector orifice.

15. An internal combustion engine, comprising:

an engine body including a mounting bore having an inner surface, a coolant passage positioned adjacent the mounting bore to receive coolant fluid, and a combustion chamber;

a fuel injector received by the inner surface of the mounting bore and including an injector body including a longitudinal axis, an outer housing having an outer surface positioned adjacent the inner surface, an injector cavity, and an injector orifice communicating with one end of the injector cavity to discharge fuel into the combustion chamber, the fuel injector including a nozzle valve element positioned in one end of the injector cavity adjacent the injector orifice, a control volume positioned to receive a pressurized supply of fuel, a drain circuit positioned within the fuel injector to drain fuel from the control volume to outside the fuel injector, and an injection control valve positioned within the injector body along the drain circuit to control fuel flow from the control volume, the injection control valve including a valve housing, a control valve member operable to control the flow of fuel from the control volume through the drain circuit, and an actuator positioned in the valve housing to cause movement of the control valve member, and the valve housing includes a valve cavity and the actuator is positioned within the valve cavity; and an engine drain circuit including an axial drain passage positioned between the inner surface of the mounting bore and the fuel injector to receive fuel drain flow from the drain circuit, the axial drain passage positioned in an overlapping side-by-side relationship with the coolant passage for at least a portion of the axial drain passage, and the axial drain passage is axially positioned between the actuator and the injector orifice, and the drain circuit further including a transverse flow passage formed in the valve housing, the transverse flow passage including a first end in fluid communication with the valve cavity and a second end in fluid communication with the axial drain passage and the first end.

16. The internal combustion engine of claim 15, the actuator including a solenoid assembly for causing axial movement of the control valve member along a longitudinal axis between said open and closed positions, the solenoid assembly including a stator including a first end and a second end positioned opposite said first end, a coil positioned around said stator, a central aperture extending through said stator from said first end to said second end for receiving the control valve member and an armature connectable to the control valve member and positioned a spaced axial distance along said longitudinal axis from the coil.

17. The fuel injector of claim 15, wherein the drain circuit further includes an outlet port formed in the outer housing to direct fuel outside of the injector body and the outlet port is positioned along the longitudinal axis axially between the actuator and the injector orifice.

* * * * *

UNITED STATES PATENT AND TRADEMARK OFFICE

CERTIFICATE OF CORRECTION

PATENT NO. : 9,291,138 B2
APPLICATION NO. : 13/666791
DATED : March 22, 2016
INVENTOR(S) : Corydon E. Morris and Paul D. Free It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 603 days.

Signed and Sealed this
Ninth Day of August, 2016

Michelle K. Lee

Michelle K. Lee
*Director of the United States Patent and Trademark Office*